United States Patent [19]

Petersen

[11] 4,224,774

[45] Sep. 30, 1980

[54] COMPOSITE BUILDING ELEMENTS

[75] Inventor: Jørgen S. Petersen, Roskilde, Fed. Rep. of Germany

[73] Assignee: Rockwool International A/S, Hedenhusene, Fed. Rep. of Germany

[21] Appl. No.: 938,611

[22] Filed: Aug. 31, 1978

Related U.S. Application Data

[63] Continuation-in-part of Ser. No. 782,876, Mar. 30, 1977, abandoned.

[51] Int. Cl.[2] ..... F04B 1/74

[52] U.S. Cl. ..... 52/404; 52/309.14; 52/730; 52/DIG. 7

[58] Field of Search ..... 52/730, 309.8, 309.9, 52/DIG. 7, DIG. 9, 376, 233, 727, 811, 404, 309.3, 309.14

[56] References Cited

U.S. PATENT DOCUMENTS

| | | | |
|---|---|---|---|
| 2,746,097 | 5/1956 | Tofani, Jr. | 52/730 X |
| 2,782,465 | 2/1957 | Palmer, Jr. | 52/DIG. 7 |
| 3,179,983 | 4/1965 | Webber et al. | 52/376 |
| 3,552,079 | 1/1971 | Mortensen | 52/233 X |

*Primary Examiner*—James A. Leppink
*Assistant Examiner*—Carl D. Friedman
*Attorney, Agent, or Firm*—Lawrence Rosen; E. Janet Berry

[57] ABSTRACT

A composite load-bearing structural column utilizable as studding in the exterior walls of wooden frame buildings includes a pair of vertically extending parallel and spaced wooden stud elements. Substantially completely filling the space between the stud elements there is positioned a core of mineral fibre felt having the fibres thereof bonded together with a resinous material. The core is joined adhesively on the respective opposite faces thereof to corresponding abutting faces of the stud elements. The core has a depth at least as great as the combined depths of the stud elements.

6 Claims, 2 Drawing Figures

COMPOSITE BUILDING ELEMENTS

This application is a continuation-in-part of application Serial No. 782,876 filed March 30, 1977 now abandoned.

BACKGROUND OF THE INVENTION

The present invention relates generally to load-bearing structural members and more particularly to composite columnar structural members which are of special value as the studding members in exterior walls of frame buildings.

In recent years the increased cost of heating energy such as fuel oil, coal and the like has led to the use of thicker layers of insulation in the outer walls and roofs of buildings. It is thus not uncommon for builders to employ batts or slabs of insulating material such as mineral fibrous material having a depth of 20 cm or more. In order to accommodate batts of such size in a frame construction building the stud members in the exterior walls must be correspondingly increased in size, e.g. exhibiting a cross-sectional area in the horizontal plane of from 5×20 cm to 7.5×20 cm. Wooden stud members of such dimensions have become extremely expensive thereby adding to the cost of constructing the building to the point where such cost is practically prohibitive. Further, by employing such large dimension stud members heat transmission through the wooden stud members is significantly increased, e.g. by as much as 20%. The beneficial effects of the increased insulating material is thus largely negated.

Another disadvantage of simply utilizing wooden stud members of increased depth in the exterior walls is that such stud members serve as "cold bridges" within the walls of the structure and lead to the condensation of moisture (humidity) within the walls. The problem of condensation within the exterior walls of the structure is exacerbated when the building is constructed in a geographic region characterized by humid weather conditions. The condensation moves inwardly within the exterior walls through capillary action until it migrates to a region along the stud members which is most susceptible to rot and fungus.

SUMMARY OF THE INVENTION

It is one object of the invention to provide a composite load-bearing structural member which can be employed as the studding in the exterior walls of wooden frame buildings which avoids the creation of regions within such exterior walls where rot and fungus conditions prevail.

It is another object of the invention to provide a composite columnar structural member which is useful as the studding in the exterior walls of wooden frame buildings which facilitates the employment of insulation material of increased depth in such exterior walls.

It is still another object of the invention to provide a composite columnar structural member formed of wooden elements having a length to transverse ratio such that they would normally be susceptible to failure under compressive load by buckling or lateral bending reinforced by a nonstructural insulating material such that the composite member is no longer susceptible to such failure under normal loading conditions.

Other objects and advantages of the invention will become readily apparent to persons versed in the art from the ensuing description of the invention.

According to the present invention there is provided a composite load-bearing structural member for use as studding in the exterior walls of wooden frame buildings comprising;

first and second parallel, spaced, vertically extending wooden stud elements;

and a core of mineral fibre felt having the fibres thereof bonded together with a resinous material, said core substantially completely filling the space between said stud elements and being joined adhesively on the respective opposite faces thereof to corresponding abutting faces of said stud elements, said core having a depth at least as great as the combined depths of said wooden stud elements.

BRIEF DESCRIPTION OF THE DRAWINGS

In order that the invention may be more fully comprehended it will now be described, by way of example, with reference to the accompanying drawings in which.

DESCRIPTION OF THE PREFERRED EMBODIMENTS

Figure 1:
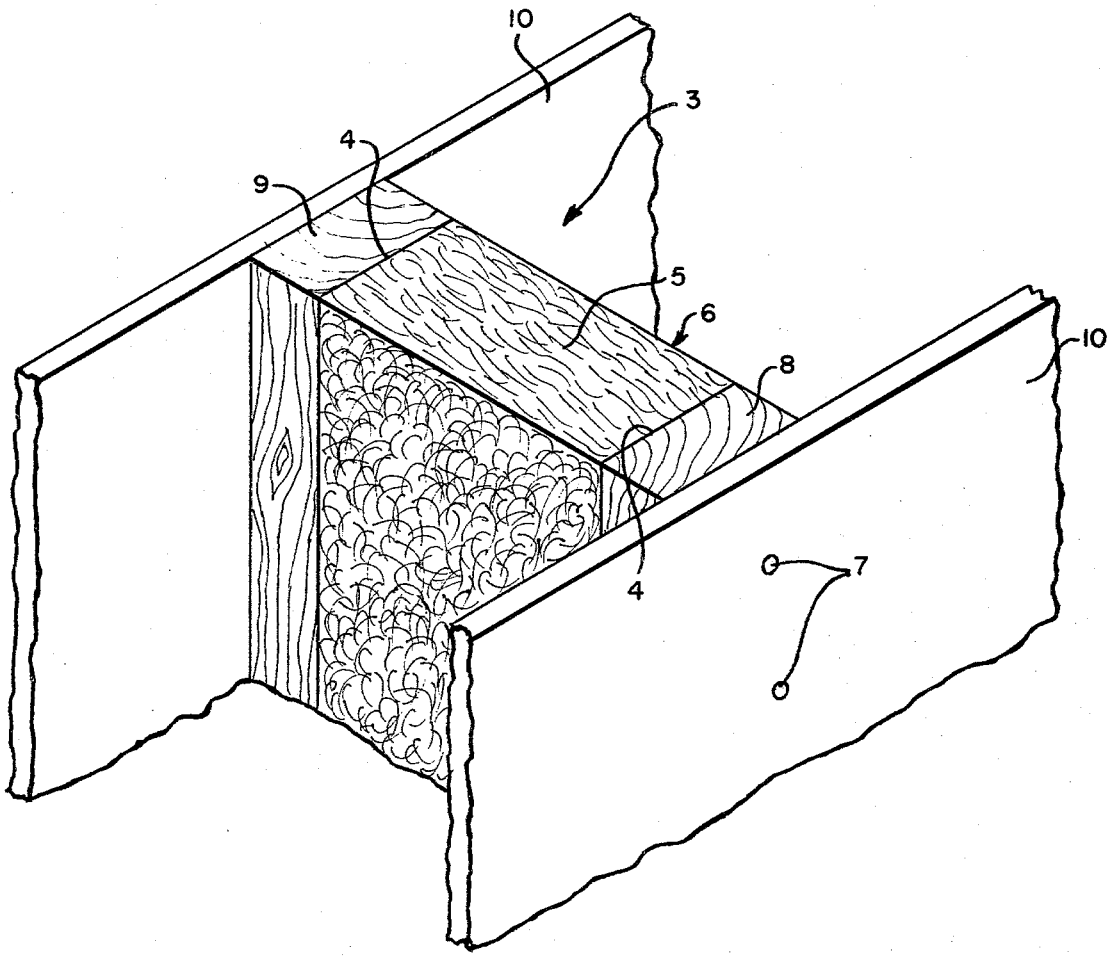
FIG. 1 is a perspective fragmentary view of a composite structural member embodying the features of the invention shown positioned between a pair of fibre boards.

Before explaining the invention in detail it is to be understood that the invention is not limited in its application to the details of construction and arrangement of parts illustrated in the drawings since the invention is capable of other embodiments and of being practiced or carried out in various ways. It is also to be understood that the phraseology or terminology employed is for purposes of description only and not of limitation.

Referring to the drawings, there is shown a composite structural member 3 which is intended as the studding 14 of the exterior wall of a wooden frame building. The structural member 3 comprises a pair of wooden stud elements 8, 9 which extend vertically in spaced parallel relationship. A core 6 of mineral fibrous material such as a fibre felt is positioned between the stud elements 8, 9 so as to substantially completely fill the space therebetween. The opposed faces of the core 6 are adhesively secured to the corresponding adjacent faces of the stud elements by means of an adhesive 4 thereby forming a unitary load-bearing member.

Within the core 6 the fibres 5 are bonded together by means of a resinous material which is preferably an organic resin. Phenol formaldehyde is the presently preferred bonding resin. Such resin bonds the fibres of the core at their points of intersection. The mineral fibrous core is a product which is formed desirably from glass, stone or slag fibres. A mineral fibrous felt or wool found to be eminently satisfactory for use as the core of member 3 possesses a porosity of from 0.92 to 0.96.

As can be clearly seen from the drawings the core 6 should have a depth which is at least as great as the combined depths of the stud elements 8, 9. Further, the core should desirably be positioned between the stud elements 8, 9 in such manner that the fibres 5 thereof are located in planes which extend generally horizontally therebetween.

In FIG. 1 the composite structural member 3 is seen as being positioned within a wall comprising fibre boards 10 which each have a thickness of 9 mm.

Figure 2:
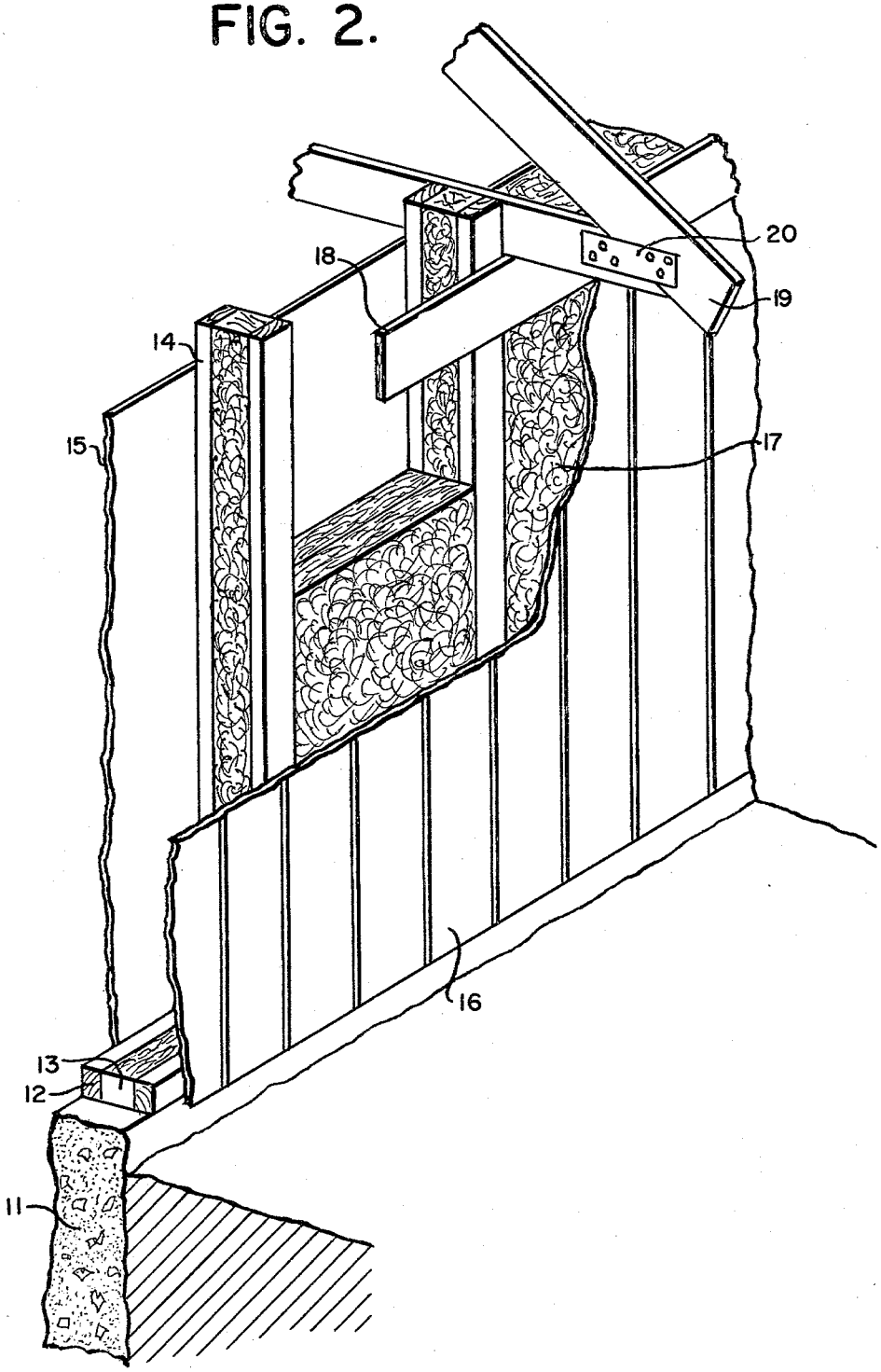
FIG. 2 is a perspective fragmentary view of a portion of the exterior wall section of a wooden frame building.

In FIG. 2 there is shown a section of an exterior wall set upon a concrete foundation wall 11. A sill, consisting of a pair of strips 12 between which is positioned insulating material 13, surmounts the foundation wall and is secured thereto by means of bolts (not shown) which may be cast in place when the concrete is poured. The exterior wall comprises composite columns or stud members 14 which rest upon the sill. Such stud members 14 are constructed as hereinbefore described and extend upwardly a distance sufficient to be integrated into the roof structure of the building so as to carry the loads imposed upon the roof such as the snow load. As is shown in FIG. 2 inner and outer wall coverings 15, 16 are fastened to the studs. Such wall coverings may be plywood nailed to the stud members. Within the wall cavity there is positioned a light-weight insulating material 17 which may, if so desired, be formed of material similar to that of core 6.

A header 18 may be seamed exteriorly of the stud members by being nailed thereto. Supported upon header 18 there may be provided a series of trusses 19 which can conveniently be fastened to the stud members by means such as plate member 20.

Applicant has found quite surprisingly that the compressive strength of a pair of columns which are long compared to their transverse dimension and which would ordinarily be susceptible to failure by buckling or lateral bending can be increased by securing the mineral fibrous core therebetween. The mineral fibrous core thus appears to act as the web of a girder and prevents bowing of the slender columnar elements in the manner of long columns which, by virtue of their length to transverse dimension, behave in accordance wih Euler's equation. The core 6 of composite structural member 3, despite the fact that it is a comparatively light, porous insulating material, thus serves to stiffen slender elements 8, 9 in an unexpected manner.

A composite stud member was formed from a core of mineral fibre felt having a porosity of 0.94 and a cross section of 5×15 cm, and two wooden stud elements each having a cross section of 5×2.5 cm. The total cross section of the construction element was 5×20 cm.

When the studding in the wall is to carry the dead weight of the components of the house above the walls, the wooden stud elements alone must be capable of transferring such load to the supporting structure below because of the much lower modulus of elasticity of the mineral fibre felt. Also in case the total load is placed on one of the wooden members it has to be safe and be able to resist collapsing. A vertical element constructed as described above was cut to have a length of 1.80 m. One of the wooden stud elements was subjected to an increasing compression load in its longitudinal direction. No collapse was experienced at a load of 5000 kp. The wooden stud element alone having a length of 1.80 m collapses under a load of 900 kp. It is seen, therefore, that the compressive strength of the individual elements is increased by virtue of their combination into the composite member of this invention.

Although the invention has been described in specific terms it will be understood that various changes may be made in size, shape and materials without description from the spirit and scope of the invention as claimed.

What is claimed is:

1. A composite load-bearing structural member for use as studding in the exterior walls of wooden frame buildings comprising:

first and second parallel, spaced, vertically extending wooden stud elements;

and a core of mineral fibre felt having a porosity within the range of from about 0.92 to 0.96 and having the fibres thereof bonded together with a resinous material, said core substantially filling the space between said stud elements and being joined adhesively on the respective opposite faces thereof to corresponding abutting faces of said stud elements, said core having a depth at least as great as the combined depths of said wooden stud elements.

2. A composite structural member according to claim 1, wherein the fibres of said core are bonded by an organic resin.

3. A composite structural member according to claim 2, wherein said resin is phenol formaldehyde.

4. A composite structural member according to claim 1, 2 or 3, wherein the fibres of said core are located in planes which extend generally horizontally between said stud elements.

5. A composite structural member according to claim 1 having a height of at least 1.8 meters, a depth of at least 20 cm. and a width of from 5 to 7.5 cm.

6. A composite structural member according to claim 1, wherein each of said stud elements is of such a length compared with its transverse dimension that if subjected to compressive loading prior to be incorporated in the composite member it would behave in the manner of a long column and be subject to Euler's equation.

* * * * *